US006561117B1

(12) United States Patent
Kell

(10) Patent No.: US 6,561,117 B1
(45) Date of Patent: May 13, 2003

(54) ACCESSORY MOUNTING TRACK FOR WATERCRAFT

(76) Inventor: Curtis Kell, 35417 Oak Knoll Rd., Burlington, WI (US) 53105

( * ) Notice: Subject to any disclaimer, the term of this patent is extended or adjusted under 35 U.S.C. 154(b) by 0 days.

(21) Appl. No.: 10/044,052

(22) Filed: Dec. 24, 2001

(51) Int. Cl.[7] ..... B63B 17/00
(52) U.S. Cl. ..... 114/343; 114/364
(58) Field of Search ..... 114/343, 364

(56) References Cited

U.S. PATENT DOCUMENTS 4,502,406 A * 3/1985 Merry ..... 114/108
5,082,328 A * 1/1992 Garelick ..... 248/415
5,409,335 A * 4/1995 Beck ..... 410/104
5,957,568 A * 9/1999 Byers ..... 362/219

* cited by examiner

*Primary Examiner*—Sherman Basinger

(74) *Attorney, Agent, or Firm*—Michael I Kroll

(57) ABSTRACT

Disclosed is an accessory mounting track for watercraft that allows a user to quickly and easily install, reposition and remove various marine and fishing accessories such as rod holders, downriggers, lantern holders, cup holders, sonar units and the like to the gunwale or transom of a boat without having to drill holes for each accessory. The accessory mounting track for watercraft comprises an elongate track member with various channels, recesses and flanges for slideably engaging with slide mounts and a track mounting assembly that secures the track member to the boat surface using a sandwich-style clamping method. Slide mounts are brackets to which the accessories are mounted. The slide mount with its respective accessory is then placed end-to-end with said track member to align the various flanges with their mating grooves and recesses and slideably engaged therewith and is free to travel along the entire length of the track although vertical travel is restricted. Once the slide mount is in the desired position a clamp bolt is tightened and the slide mount is held rigidly in position. Slide mounts are available in various sizes and have and assortment of recess configurations to accommodate different common accessories.

17 Claims, 15 Drawing Sheets

ACCESSORY MOUNTING TRACK FOR WATERCRAFT

BACKGROUND OF THE INVENTION

1. Field of the Invention

The present invention relates generally to mounting assemblies, and more specifically, to an accessory mounting track for watercraft which features an open architecture that allows a user to slidably mount a wide variety of accessories from many manufactures. Boaters, and particularly fisherman, often need a wide range of accessories such as rod holders, cup holders, downriggers, lantern holders, sonar units etc. which frequently require drilling one or more holes in the transom or gunwale and permanently mounting the accessory thereto and then patching the resulting hole when the accessory is removed therefrom. Mounting assemblies that have attempted to address the problem require the user to drill the holes for mounting accessories into a track mounted to the gunwale or transom which does reduce the amount of holes drilled into the boat structure but still has the accessory remain in a fixed position. Additionally, holes frequently must be drilled in the rail to mount the accessories. Another style mounting assembly known in the art is a track that requires holes in the base to mount it to the boat The accessories mount directly into the slide details. The manufacturer has designed custom rod holders and downrigger swivels that slide into the track. An optional slide plate is provided for smaller accessories. The accessories are locked into position with thumb screws that travel through threaded holes in the slide plate and then bind into the track to lock into position. Each time the accessory is repositioned another binding mark is created in the bottom of the track thereby disturbing the aesthetics thereof. The manufacturer offers plastic inserts that can be cut to length and installed between the accessories to create a non-slip surface. A long piece of plastic insert material is placed in the track when no accessories are installed to improve the look of the track and also to provide a non-slip surface.

The present invention seeks to overcome the inherent disadvantages of the prior art by providing a track mounting system wherein accessories are fastened to slide mounts which are slidably installed onto a track assembly to allow the user to rapidly and easily install, reposition and remove accessories as needed. The track assembly has an integral non-slip top surface and can hold a plurality of accessories, all of which may be repositioned longitudinally along the track assembly and then secured at a specific location by means of a clamping bolt.

The mounts have different sized mounting surfaces to accommodate different accessories and the mounting surfaces are predrilled to accept standard configurations of mounting hardware of common fishing and marine accessories. Furthermore, the slide mounts with respective slide clamps leave no visible mark on the track member that results from the binding action of the thumbscrews used in the prior art. The present invention provides improved aestetic qualites since mounting hardware is not visible whether or not any accessories are mounted thereon and use the repositioning of the slide mounts do not mar the track surface.

2. Description of the Prior Art

There are numerous mounting assemblies for fishing and marine accessories, while these devices may be suitable for the purposes for which they were designed, they would not be as suitable for the purposes of the present invention as hereinafter described.

SUMMARY OF THE PRESENT INVENTION

A primary object of the invention is to provide an accessory mounting track for watercraft that allows a user to quickly and easily install, reposition and remove accessories as needed.

An additional object of the invention is to provide an accessory mounting track for watercraft that is directly mounted to the gunwale or transom of a boat.

A further object of the present invention is to provide an accessory mounting track for watercraft having a track clamp assembly for fastening the track member to the boat so that no mounting hardware is visible.

A yet further object of the present invention is to provide an accessory mounting track for watercraft wherein the track member has a slotted groove extending longitudinally on both sides to accommodate mating flanges of the slide mounts which are installed by inserting the flanges into the corresponding grooves at a distal end of the track member and sliding the slide mount and its respective accessory medially along the member.

Another object of the present invention is to provide an accessory mounting track for watercraft wherein the slide mount has a slide clamp to secure the slide clamp to the track member and increase the tensile integrity of the connection especially when increased rotational forces are exerted thereupon by accessories such as downriggers and the like.

Still another object of the present invention is to provide an accessory mounting track for watercraft wherein each slide mount has a thumb screw or other such locking means to work conjunctively with the slide clamp to secure the slide mount in the desired location.

Yet another object of the present invention is to provide an accessory mounting track for watercraft wherein the lower track clamp is wider than the rest of the track assembly and is screwed or bolted to a base plate fastened to the gunwale thus permitting the user to easily and rapidly remove the entire track assembly so only the base plates are visible.

One other object of the present invention is to provide an accessory mounting track for watercraft having a locking means located on each distal end so as to prevent unauthorized removal of the slide clamps and their respective accessories.

Still another object of the present invention is to provide an accessory mounting track for watercraft wherein the top portion of the track member has grooves running longitudinally thereacross to form a non-skid surface that can be used as a step when boarding and unboarding.

Yet another object of the present invention is to provide an accessory mounting track for watercraft having quick slide mounts that allow a user to add a temporary accessory without having to remove any of the existing accessories.

Still yet another object of the present invention is to provide an accessory mounting track for watercraft wherein the track member has gull-wing style mounting flanges for bolting the track member directly to the gunwale or transom of a boat.

An additional object of the present invention is to provide an accessory mounting track for watercraft having a track clamp assembly for fastening a track member to a boat without the necessity for holes in the track member itself.

One more object of the present invention is to provide an accessory mounting track for watercraft wherein the track clamp assembly is secured to the track in such a fashion as to increase the tensile integrity of the connection especially when increased rotational forces are exerted thereupon by accessories such as downriggers and the like.

Yet another object of the present invention is to provide an accessory mounting track for watercraft wherein the track clamp assembly can be slidably positioned along the length of the track member.

Still another object of the present invention is to provide an accessory mounting track for watercraft wherein the slide mount has a thumb screw or other such locking means to work conjunctively with the slide clamp that secures the slide mount in the desired location without marring, gouging or damaging the track member in any way.

Another object of the present invention is to provide an accessory mounting track for watercraft that provides a visible and useable non-slip surface between accessories installed on slide mounts.

Another object of the present invention is to provide an accessory mounting track for watercraft that could be wall-mounted in a garage, shed or other like structure for storing accessories when not in use.

One more object of the present invention is to provide an accessory mounting track for watercraft that is simple and easy to use.

A further object of the present invention is to provide an accessory mounting track for watercraft that is economical in cost to manufacture.

Further objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 14:
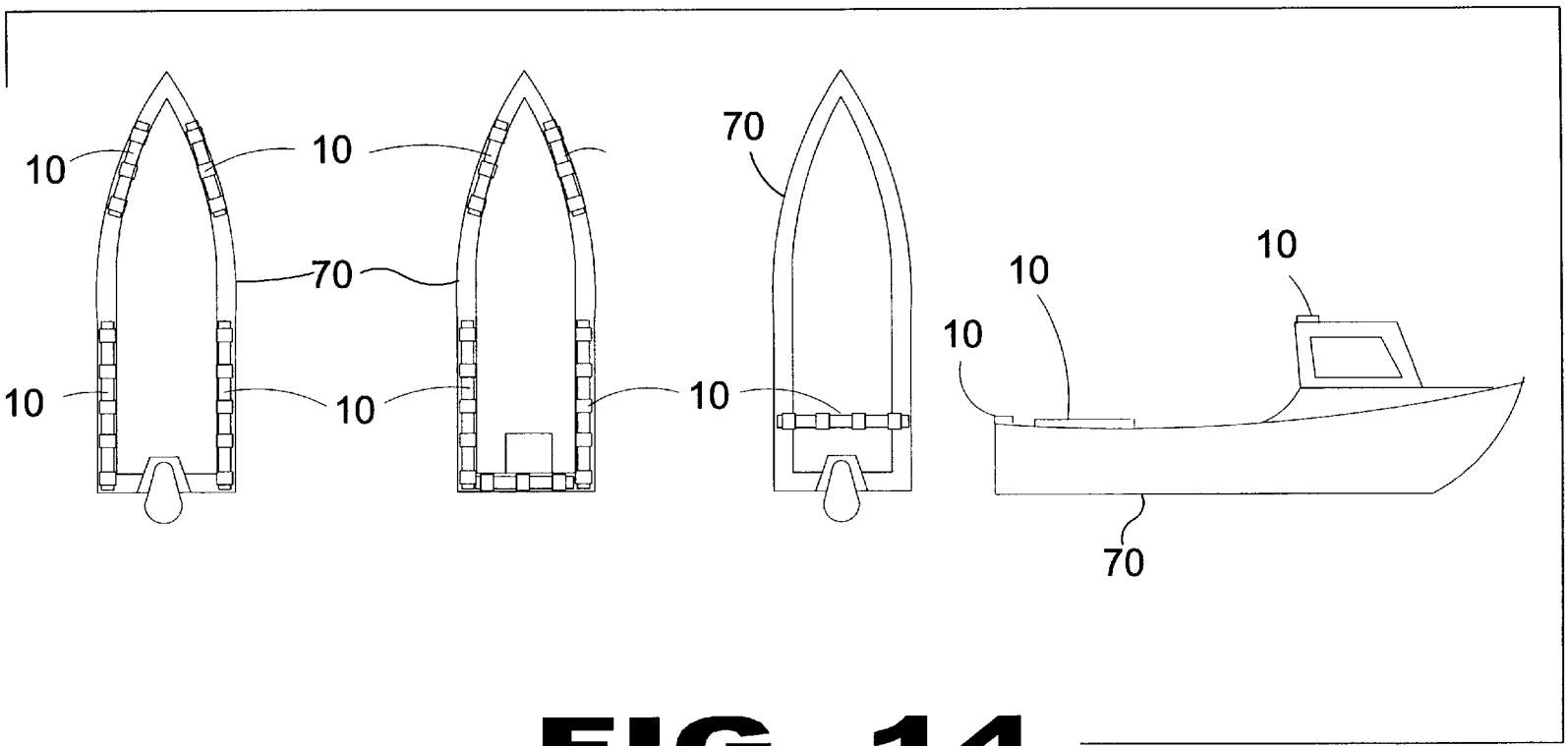

FIG. 14 demonstrates several possible mounting configurations of the present invention.

Figure 15:
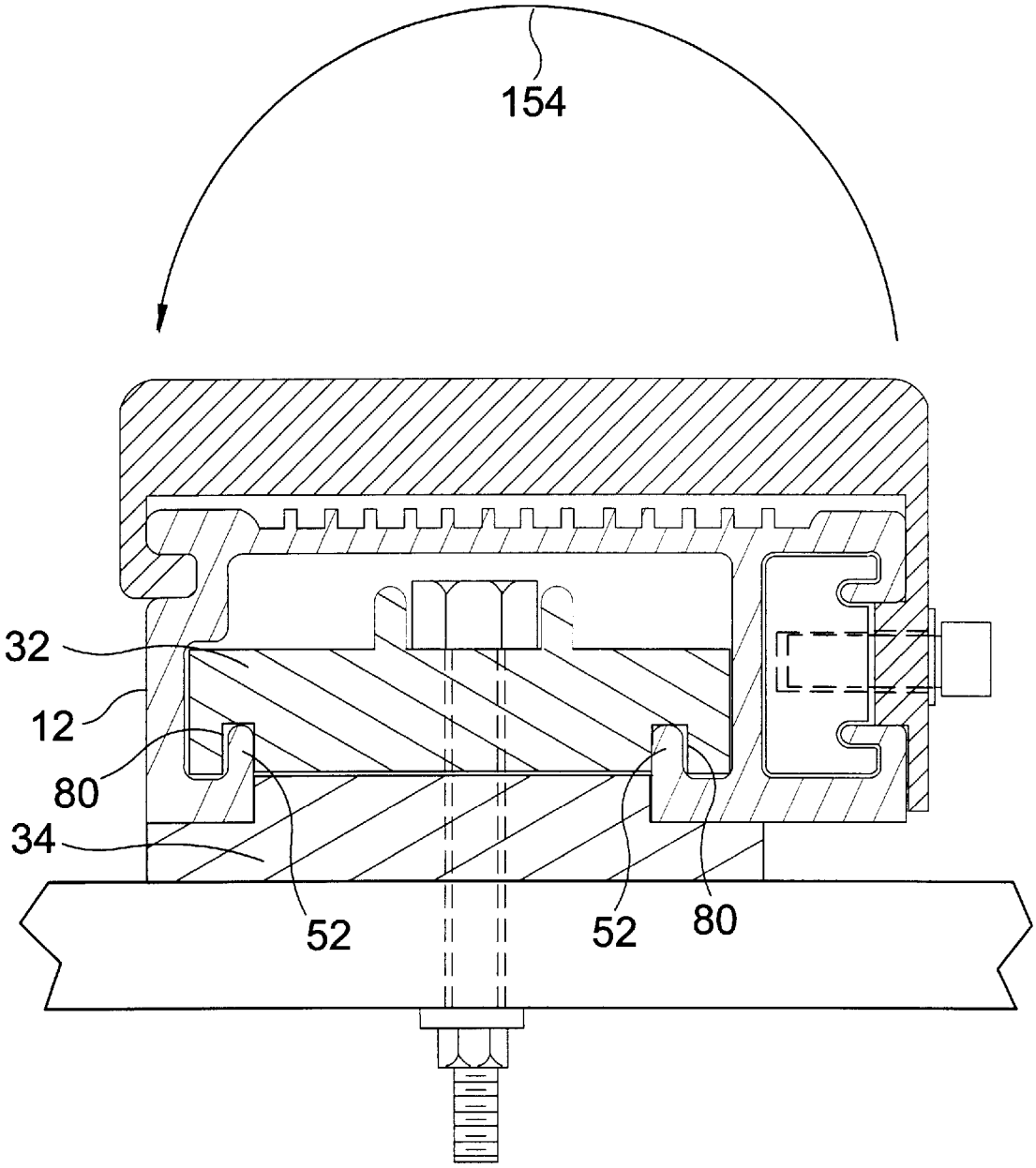

FIG. 15 is a cross sectional side view of the present invention with rotational force exerted thereupon.

DESCRIPTION OF THE REFERENCED NUMERALS

Turning now descriptively to the drawings, in which similar reference characters denote similar elements throughout the several views, the Figures illustrate the track mounting system of the present invention. With regard to the reference numerals used, the following numbering is used throughout the various drawing figures.

10 accessory mounting track for watercraft
12 track member
14 track clamping assembly
18 top plate of track member
20 clamp bolt washer
22 slide mount assembly
24 slide mount
25 large slide mount
26 slide mount clamp assembly
27 small slide mount
28 slide clamp
30 clamp bolt
32 upper track clamping member
34 lower track clamping member
36 bolt
38 washer
40 nut
42 mounting plate
44 first side of top plate
46 second side of top plate
48 first wall of track member
50 second wall of top plate
52 track clamp retaining flange
54 lower slide clamp containment lip
56 bottom surface of top plate
58 top surface of top plate
60 end of top plate
62 upper slide clamp containment lip
64 slide clamp recess
66 slide mount receiving channel
68 upper track clamp recess
70 boat
72 accessories
74 top of upper track clamping member
76 bottom of upper track clamping member
78 bolt recess of upper track clamping member
80 track clamp retaining flange channel
82 top surface of lower track clamping member
84 bottom of lower track clamping member
86 bolt recess of lower track clamping member
88 top surface of mounting plate
90 mounting recess of mounting plate
92 bottom surface of mounting plate

94 first vertical plate of slide mount
96 flange of first vertical plate
98 second vertical plate of slide mount
100 clamping flange
101 clamping flange recess
102 mounting surface
104 bolt retaining means
106 locking recess in first wall of track member
108 locking recess in second wall of track member
110 locking pin
112 lock
114 key
116 first channel of side clamp
118 second channel of slide clamp
120 quick mounting slide mount
122 mounting plate of 120
124 vertical plate of 120
126 direct mount track member
128 mounting flange
130 screw recesses
132 top plate of direct mount track member
134 first wall of direct mount track member
136 second wall of direct track member
138 base plate style upper clamping member
140 base plate style lower clamping member
142 base plate
144 bolts
146 threaded recesses of base plate
148 first set of recesses on lower track clamping member
150 second set of recesses on lower track clamping member
152 flush mount bolts
154 rotational force

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to appended claims.

Figure 1:
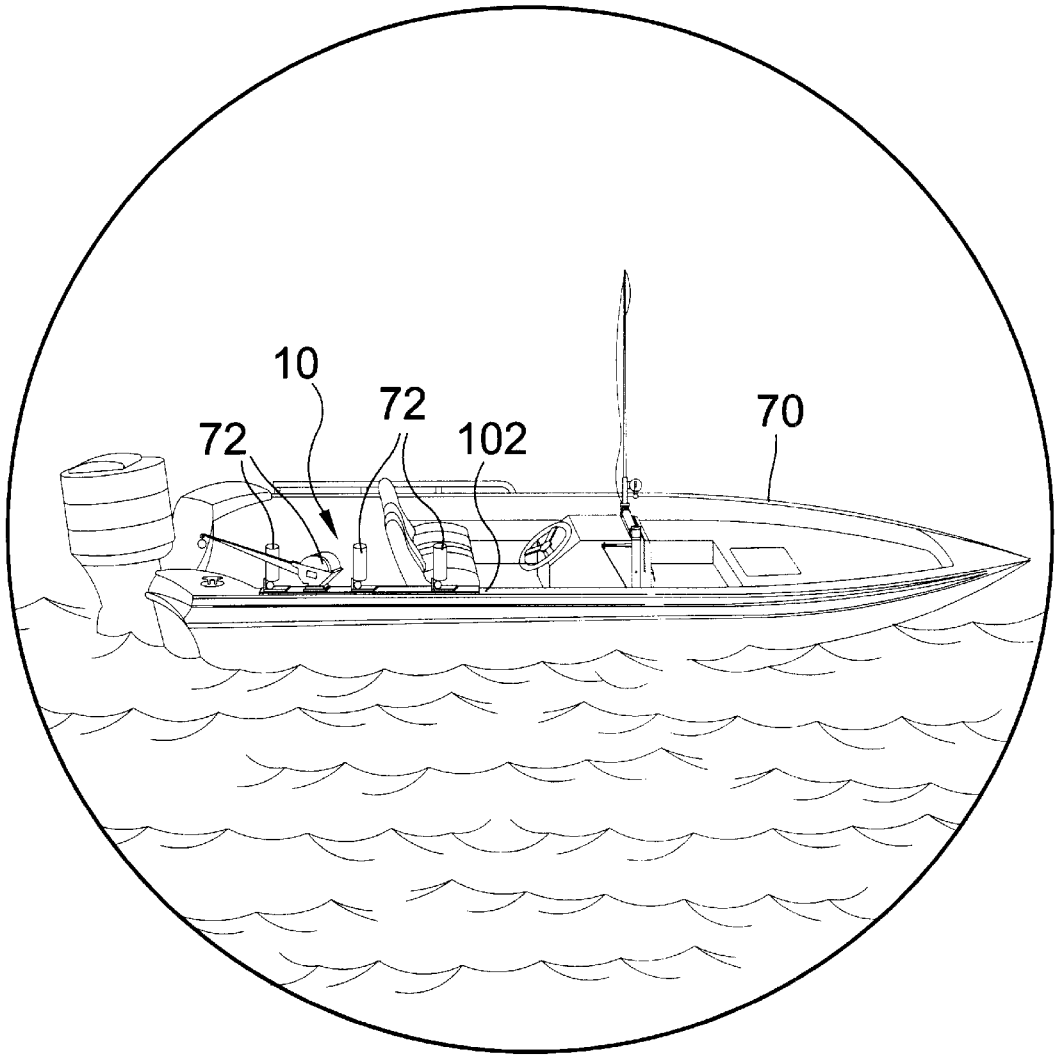
FIG. 1 is a the present invention in use.
Figure 2:
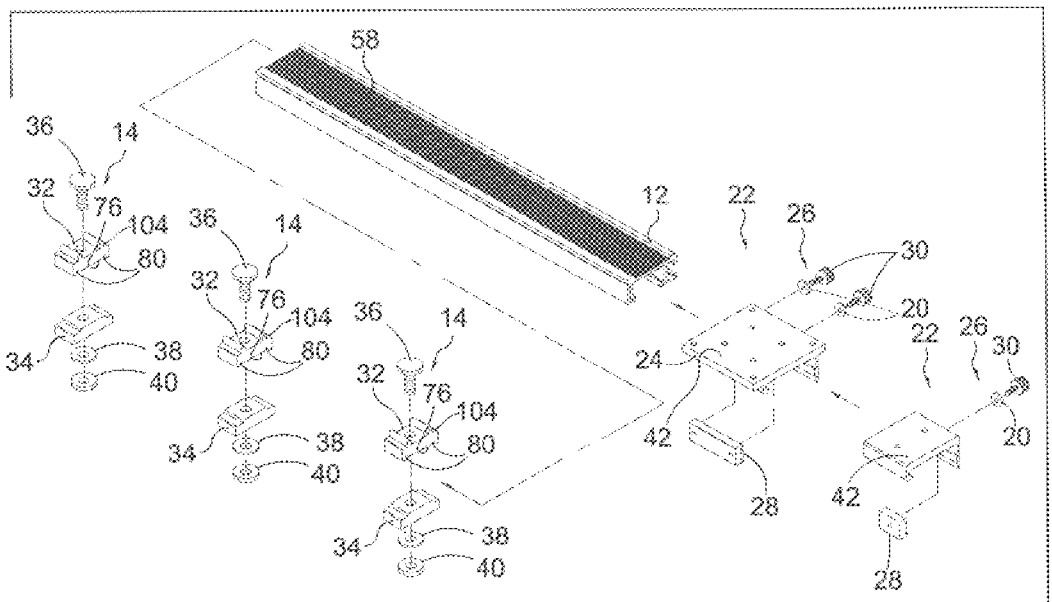
FIG. 2 is an exploded perspective view of the present invention.

The present invention shown in FIG. 1 is an accessory mounting track for watercraft 10 installed on the gunwale of a boat 70 and having various accessories 72 mounted thereon. The details of the various components of the present invention 10 and their relations to one another become more apparent when viewing the exploded view depicted in FIG. 2 which shows the track member 12 which gets removably mounted to a mounting surface 102 such as the gunwale or transom of a boat 70 by at least two track clamping assemblies 14, each track clamping assembly 14 having an upper track clamping member 32 and a lower track clamping member 34 cooperating as a sandwich clamp to retain the track member 12. Once the track member 12 is locked into place the slide mount assemblies 22 are ready to be installed. Marine or fishing accessories 72 are screwed or bolted onto the mounting plate 42 of the slide mount 24 and then the slide mount 24 with its respective accessory 72 is slidably installed on the track member 12. A slide mount clamp assembly 26 is attached to the slide mount 24 and used to secure the slide mount 24 and its respective accessory 72 once in the desired position along the track member 12. The accessory 72 could be repositioned by loosening the slide mount clamp assembly 26 and sliding the slide mount 24 along the track member 12 to a different location and securing it thereto.

Figure 3:
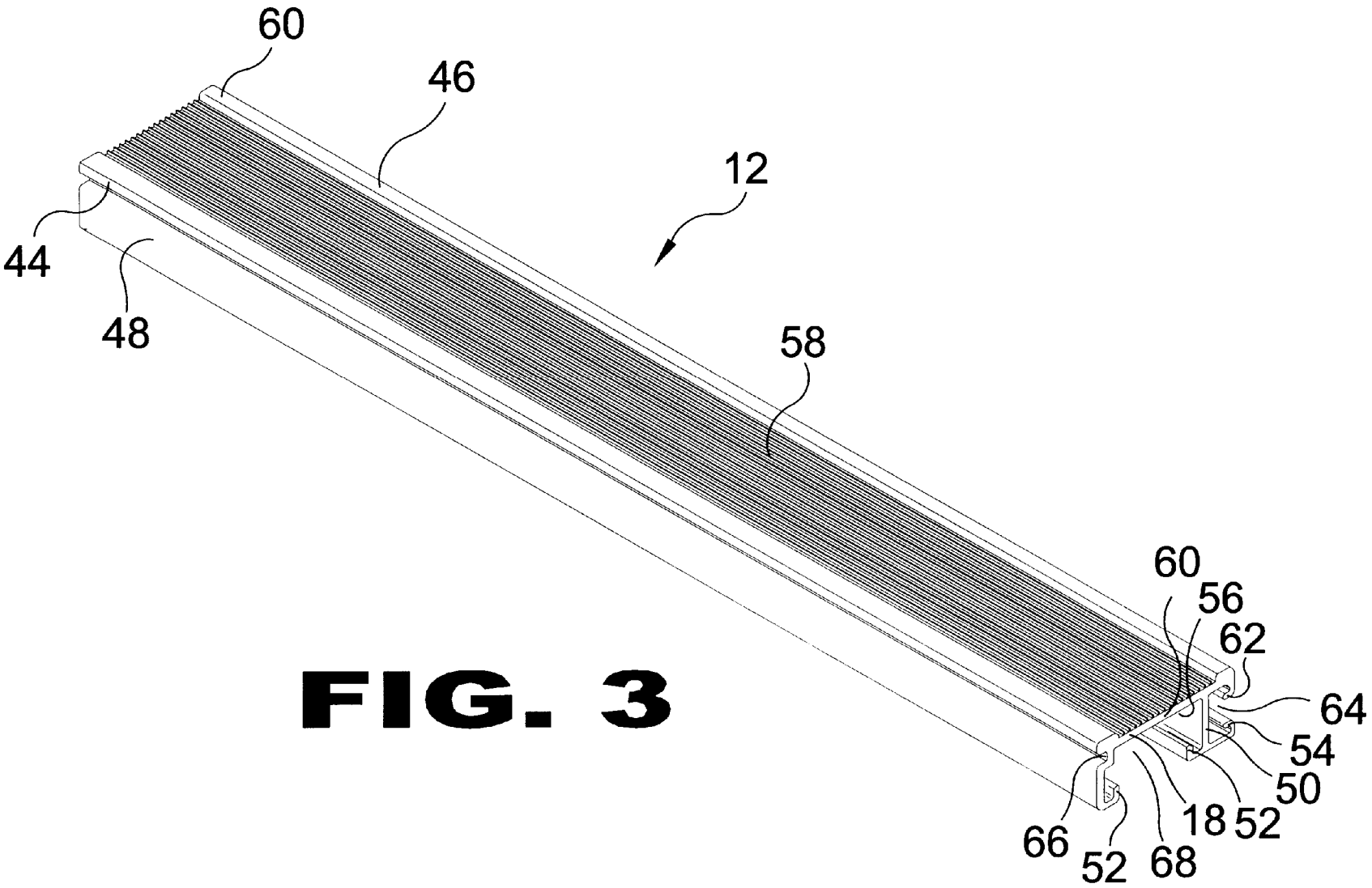
FIG. 3 is a perspective view of the track member.

FIG. 3 is a perspective view of the track member 12 wherein a substantially horizontal top plate 18 has a first side 44 with a longitudinal first wall 48 extending downward therefrom and a second wall 50 parallel to the first wall 48 extending downward from a portion of the bottom surface 56 of the top plate 18 proximal the second side 46 of the top plate 18. A slide mount receiving channel 66 extends longitudinally along an upper portion of the first wall 48. A track clamp retaining flange 52 extends horizontally from the bottom of the first wall 48 towards a central portion of the track member 12 and terminates with a vertical plate. An opposing track clamp retaining flange 52 projects horizontally from the bottom of the second wall 50 and terminates with a vertical plate. An upper track clamp recess 68 is defined by the first wall 48 and its respective track clamp retaining flange 52, the second wall 50 and its respective track clamp retaining flange 52, and the bottom surface 56 of the top plate 18. The track member 12 installs onto the track clamping assemblies 14 by slidably engaging the upper track clamping members 32 wherein the horizontal portion of track clamp retaining flanges 52 are situated between the upper track clamping members 32 and the lower track clamping members 34 and the vertical portions of the track clamp retaining flanges 52 travel within the track clamp retaining flange channels 80 on the bottom side 76 of the upper track clamping members 32. A lower slide clamp containment lip 54 projects peripherally and horizontally from the bottom of the second wall 50 until perpendicular with the edge of the second side 46 of the top plate 18 where it turns vertically upward and then terminates with a medially oriented horizontal plate. An upper slide clamp containment lip 62 extends vertically downward from the second side 46 of the top plate 18 for a short distance and terminates with a medially oriented horizontal plate. A slide clamp recess 64 is defined by the upper slide clamp containment lip 62, the lower slide clamp containment lip 54, the second wall 50 and the bottom surface 56 of the top plate. A slide clamp 28 travels within the slide clamp recess 64 when the slide mount 24 is installed on the track member 14.

Figure 4:
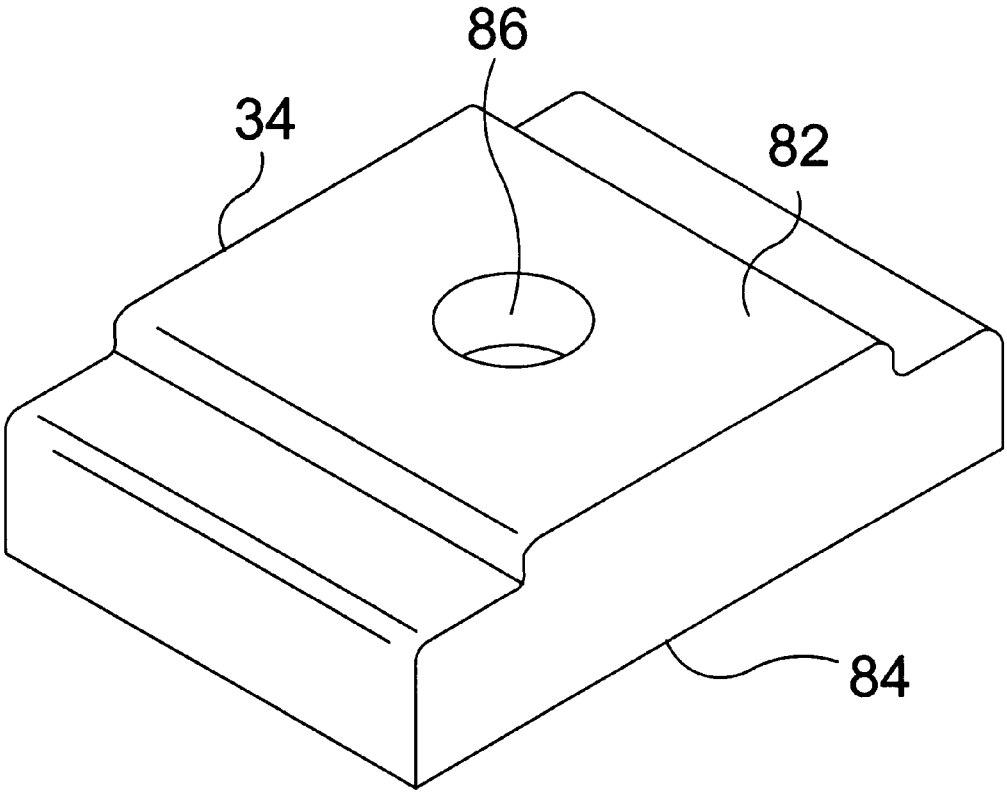
FIG. 4 is a perspective view of the lower track clamp of the present invention.

A lower track clamping member 34 is shown in a perspective view in FIG. 4 and has a top surface 82 that is longitudinally notched on the two opposing sides, a bottom 84 that is placed on the mounting surface 102 of the boat 70, and at least one bolt recess 86 that passes therethrough from top to bottom to receive a mounting bolt 36 and serve as a template for drilling the corresponding holes that are to be drilled into the mounting surface 102.

Figure 5:
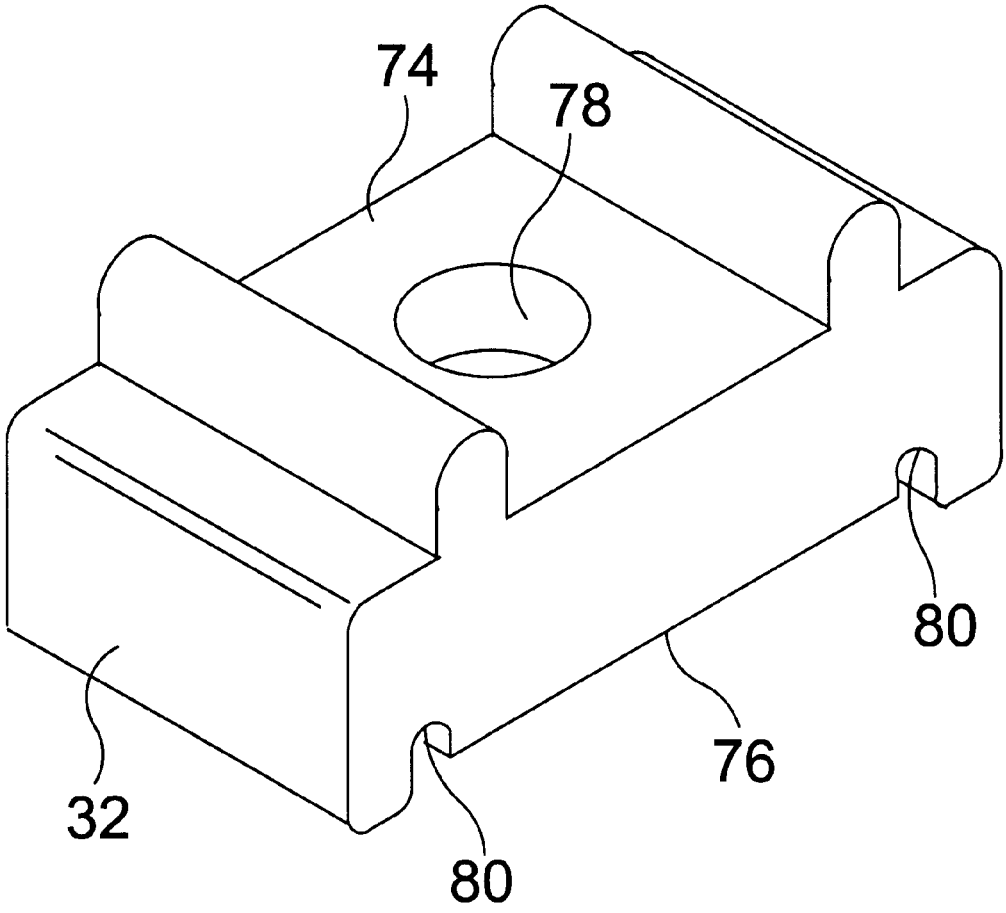
FIG. 5 is a perspective view of the upper track clamp of the present invention.

An upper track clamping member 32 is depicted in perspective view in FIG. 5 and has a top surface 74, a bottom 76 having two parallel track clamp retaining flange channels 80 extending longitudinally thereon, at least one bolt recess 78 that passes therethrough from top to bottom to receive a mounting bolt 36, and a bolt retaining means 104 on the top surface 74 thereof to prevent the retaining bolt 36 from spinning during installation and removal.

Figure 6:
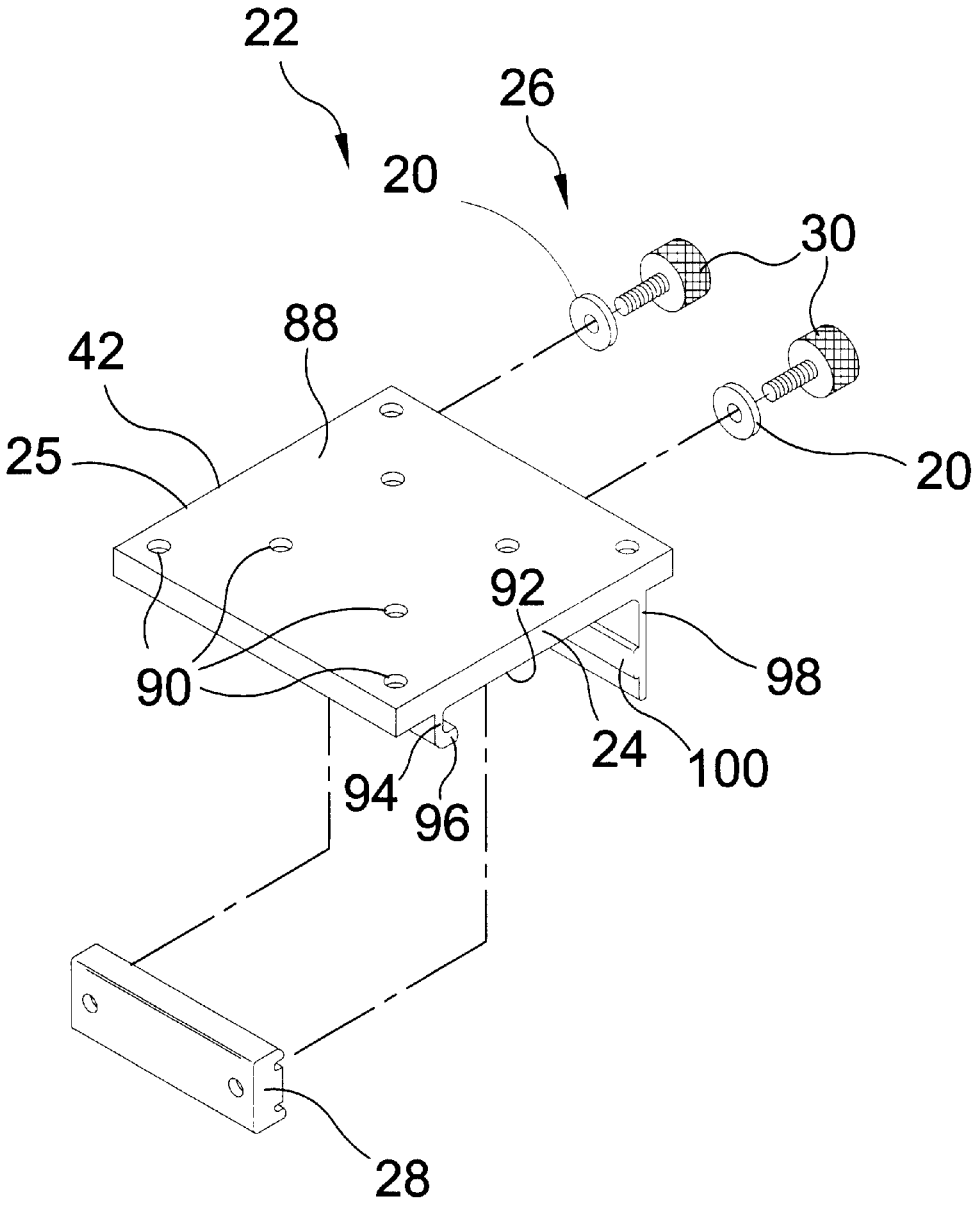
FIG. 6 is an exploded perspective view of a slide mount and its related clamping components.
Figure 7:
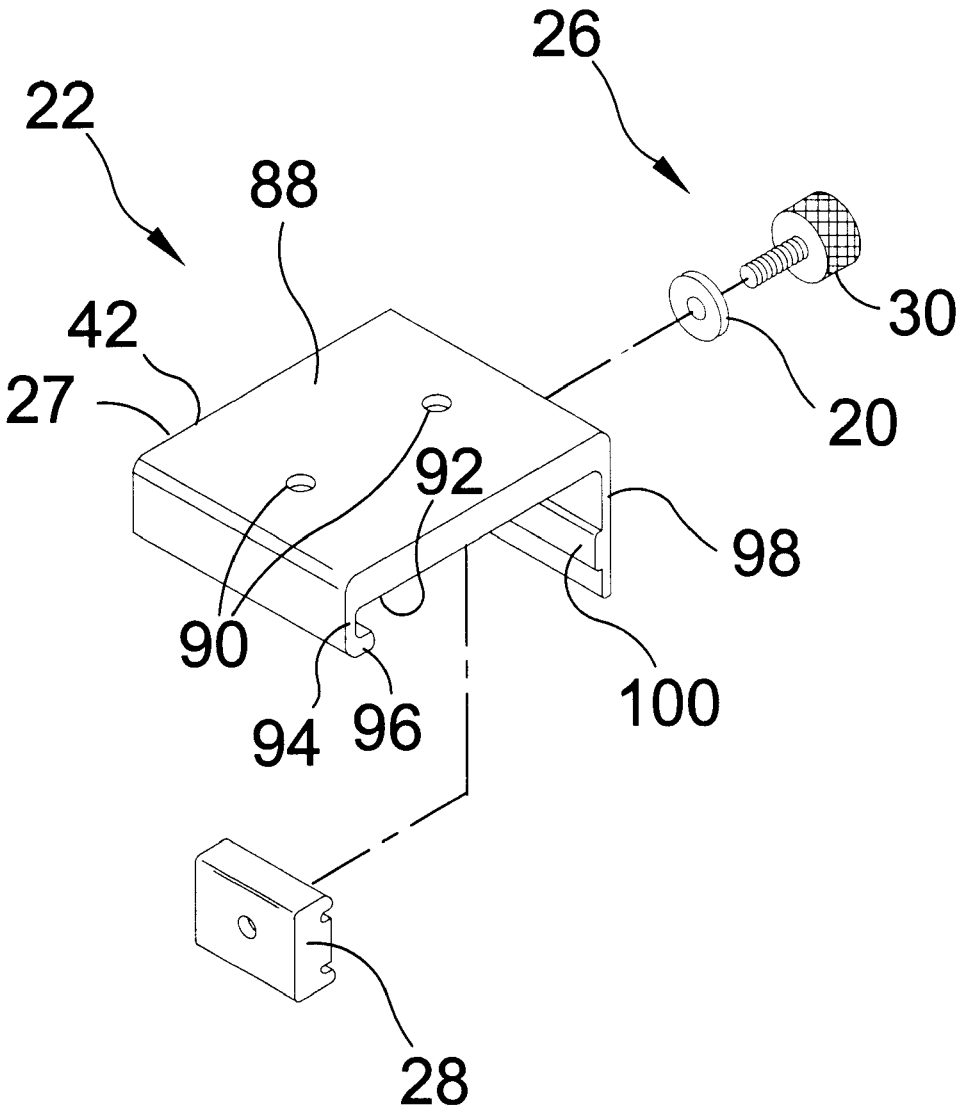
FIG. 7 is an exploded perspective view of a slide mount and its related clamping components.

FIGS. 6 & 7 are exploded perspective views of slide mounts 24 and their respective clamp assemblies 26 wherein FIG. 6 shows a slide mount 24 having a mounting plate 42 that is large enough to support accessories such as downriggers and other such accessories 72 that might require a larger mounting surface and has manufactured recesses 90 for mounting the same thereto whereas FIG. 7 demonstrates a smaller mounting plate 42 to accommodate rod holders, cup holders and the like. Each mounting plate 42 has a top surface, a bottom surface and at least one mounting recess passing therethrough. A first vertical plate 94 extends downward from the bottom surface of the mounting plate 92 and the distal edge thereof has a horizontal flange 96 projecting towards a central portion of the mounting plate 42. A second vertical plate 98 projects down from the opposing end of the mounting plate 42 and has a clamping flange 100 that corresponds with the opening of the slide clamp recess 64 as defined by the area between the upper slide clamp containment lip 62 and the lower slide clamp containment lip 54.

Figure 8:
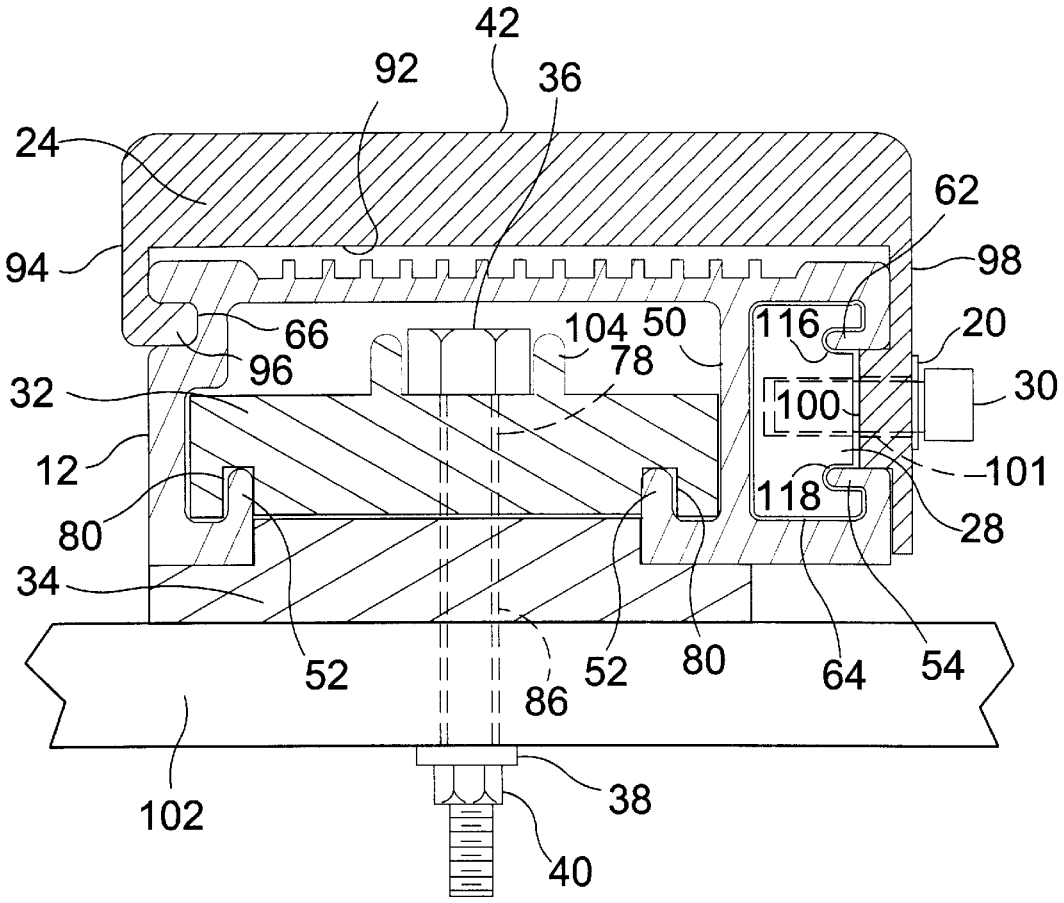
FIG. 8 is a cross-sectional side view of the present invention mounted on a boat.

At least one clamp flange recess 101 large enough for the clamp bolt 30 to freely pass through is located on the clamping flange 100 and is shown in FIG. 8 as are all of the primary components of the present invention 10 and their physical relations to one another. The upper track clamping member 32 and the lower track clamping member 34 are mounted onto the mounting surface 102 with bolts 36 that have been inserted into the aligned bolt recesses of the upper track clamping member 78 and the bolt recesses of the lower track clamping member 86 and through holes drilled into the mounting surface 102 by the user. A bolt retaining means 104 prevents the bolts 36 from spinning when tightening and loosening the accompanying nut 40 when the track member 12 is installed and preventing access thereto. The clamp bolt 30 is inserted through the clamping flange recess 101 and threaded into a recess in the slide clamp 28. The slide mount 24 was placed end to end with the track member 12 to align the flange of the first vertical plate 96 with the slide mount receiving channel 66 and the slide clamp 28 and the clamping flange of the slide mount 24 with the slide clamp recess 64 including the alignment of the upper slide clamp containment lip 62 with the first channel of the slide clamp 116 and the lower slide clamp containment lip 54 with the second channel of the slide clamp 118 thereby slidably engaging the slide mount assembly 22 with the track member 12.

Figure 9:
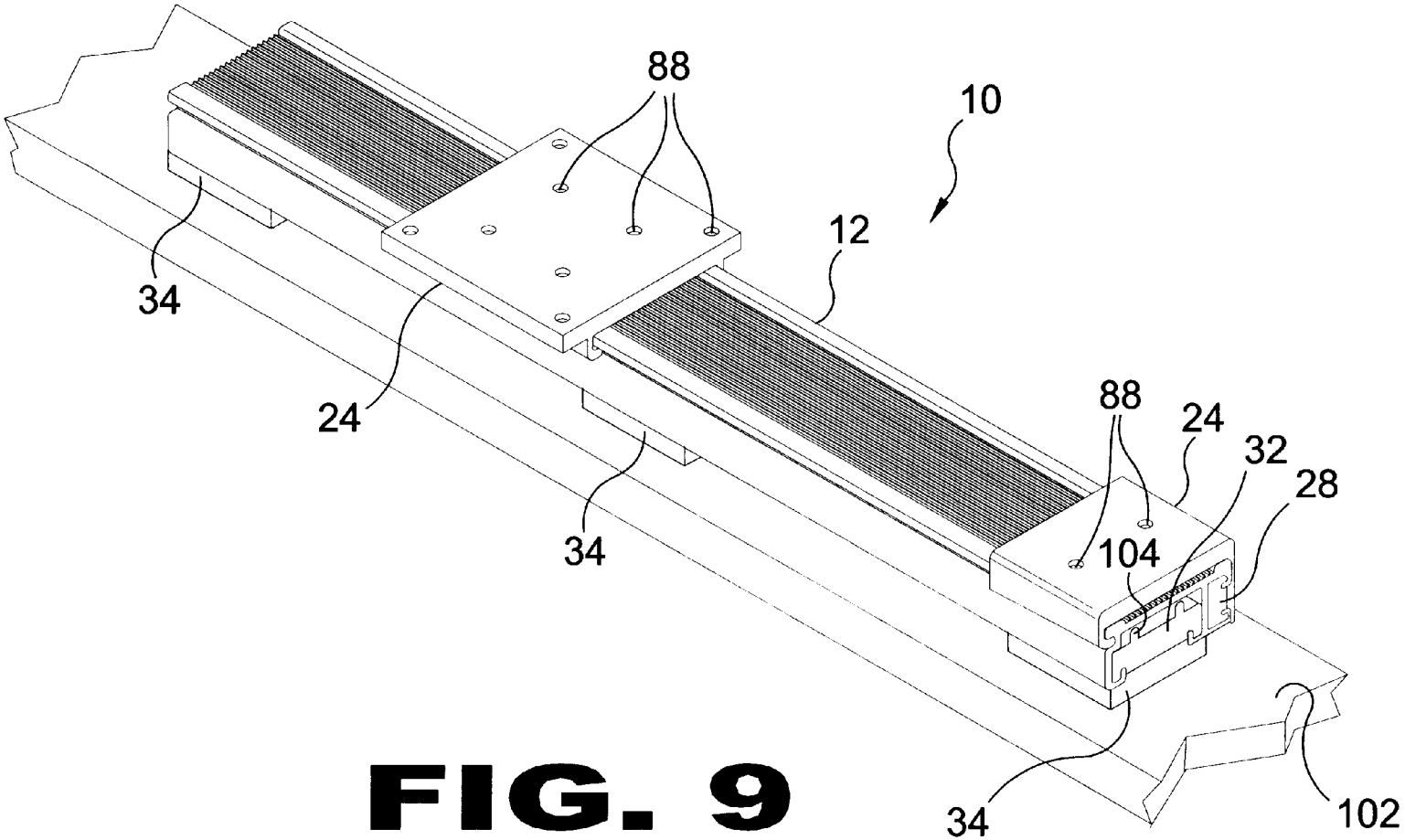
FIG. 9 is a perspective view of the present invention mounted on a boat.

FIG. 9 is a perspective view of the present invention 10 with the track clamping assembly 14 bolted to the mounting surface 102 and the track member 12 installed thereon. A large slide mount 25 and a small slide mount 27 are installed on the track member 12.

Figure 10:
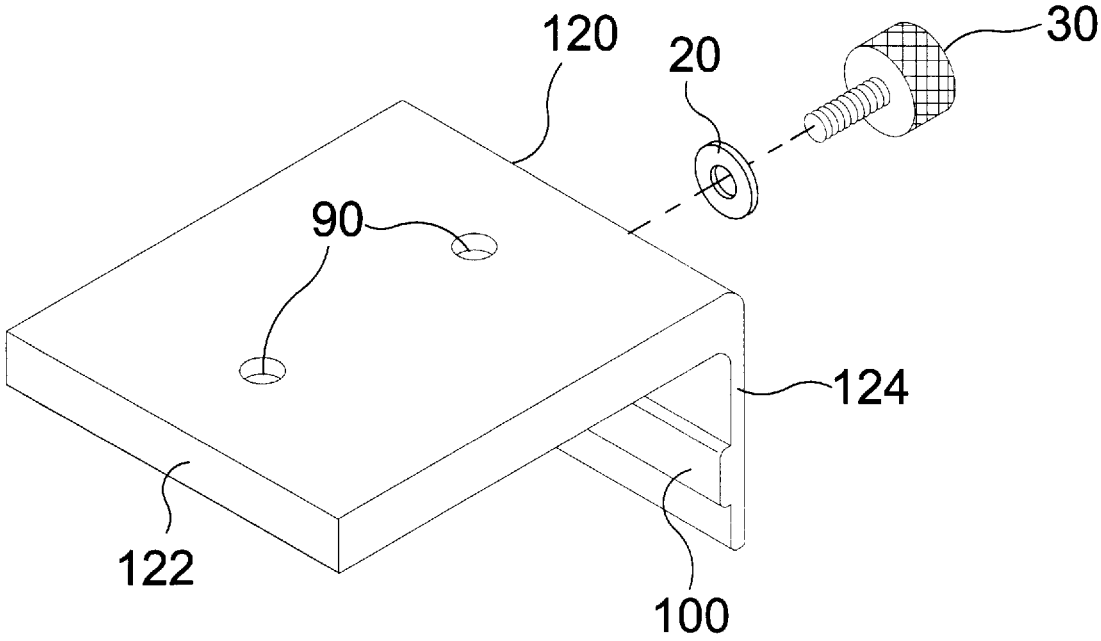
FIG. 10 is a perspective view of a quick-slide mount.

A quick mounting slide mount 120 is shown in FIG. 10 having a substantially horizontal mounting plate 122 for installing an accessory 72 thereto and one vertical plate 124 extending perpendicularly downward therefrom to accommodate a clamp assembly thereby allowing a user to directly install a quick mounting slide mount 120 and its respective accessory 72 to any place on the track member 12 without having to slidably install it end-to-end.

Figure 11:
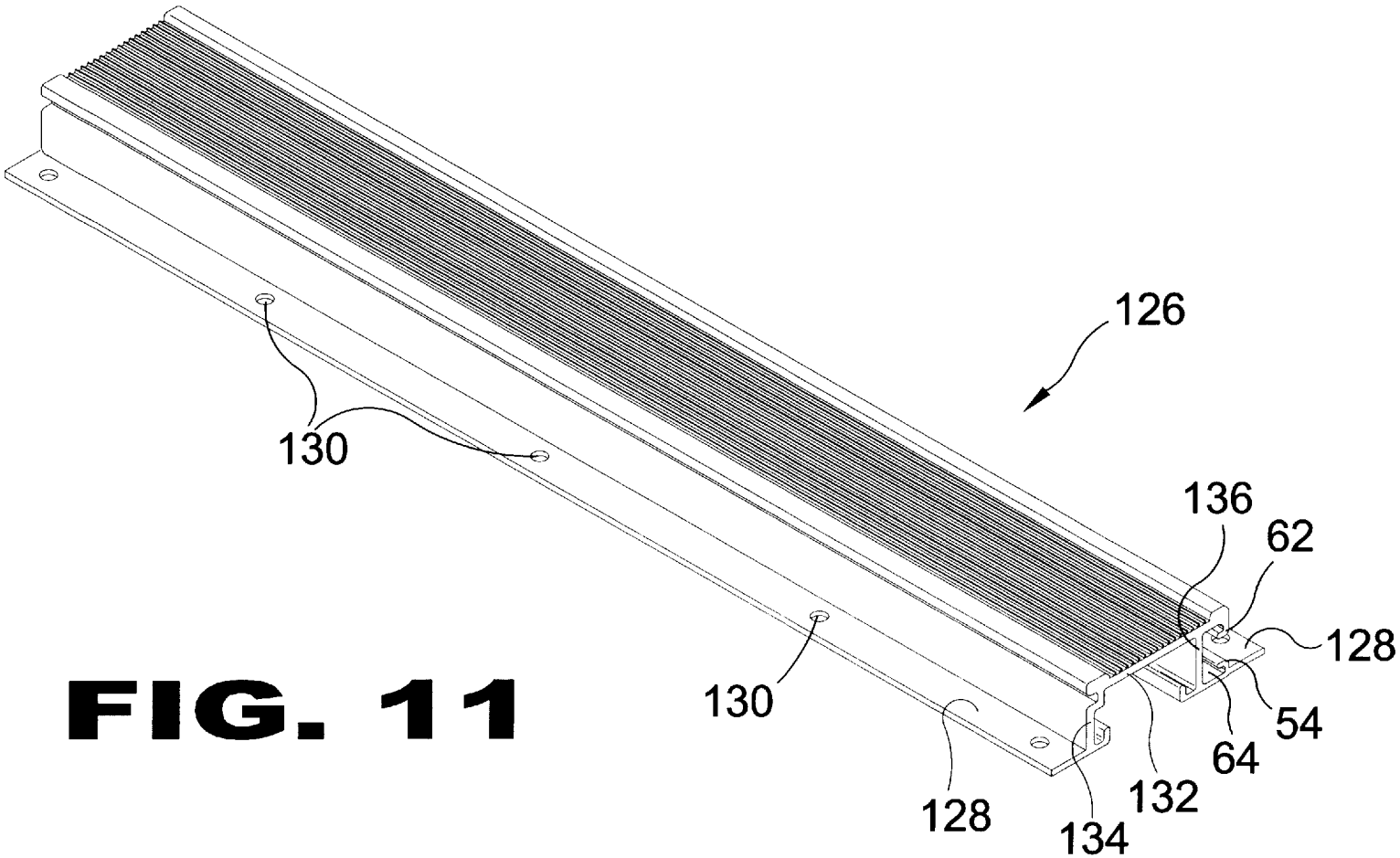
FIG. 11 is a perspective view of the track member having gull-wing style mounting flanges.

FIG. 11 shows a perspective view of a direct mount track member 126 that has gull wing style mounting flanges 128 having a plurality of screw recesses 130 to bolt or screw the direct mount track member 126 directly onto the mounting surface 102. The direct mount track member 126 has a top plate 132 with a first wall 134 extending perpendicularly downward therefrom and a second wall 136 parallel and equidistant to the first wall. The mounting flanges 128 project vertically outward from the bottom edges of the first wall 134 and the second wall 136

Figure 12:
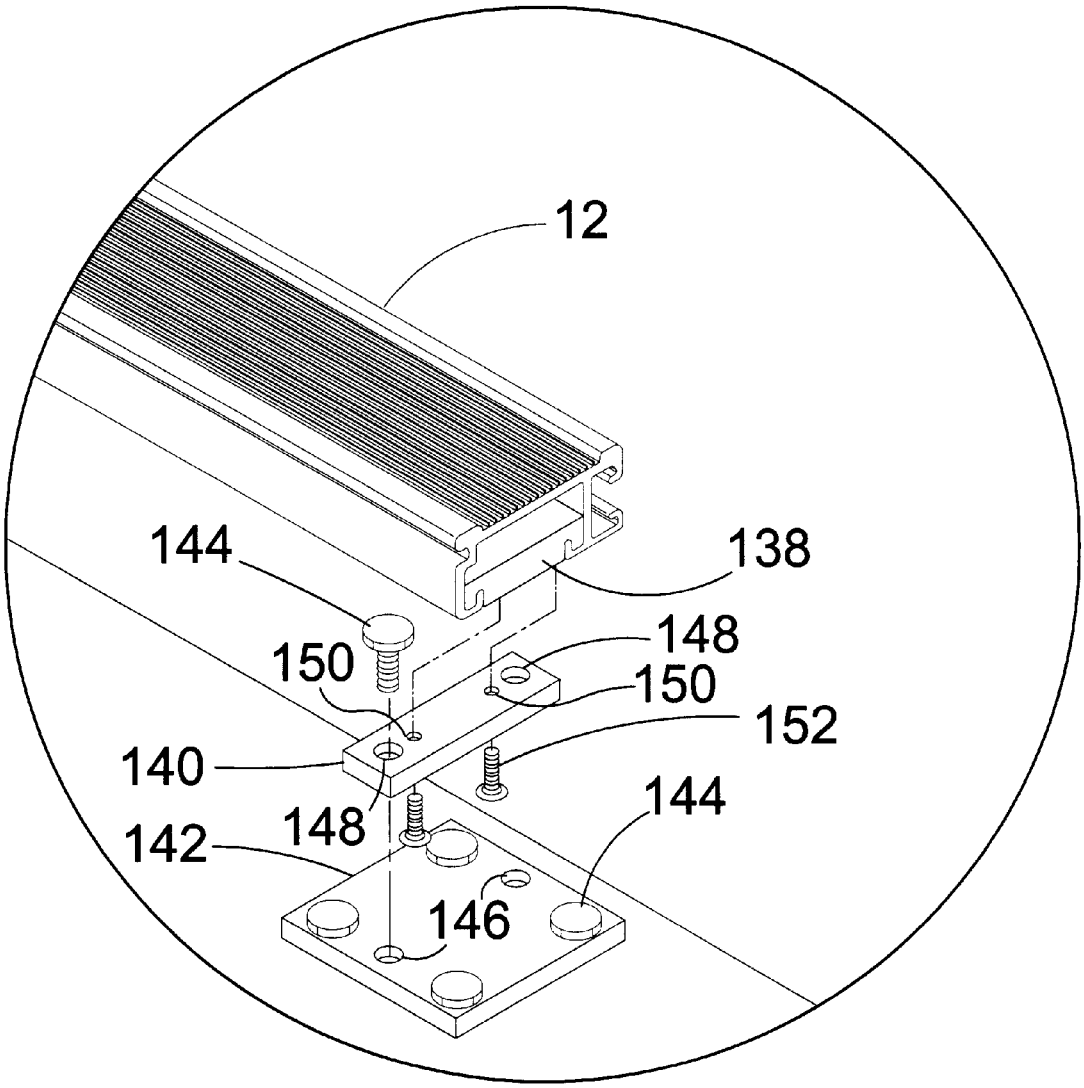
FIG. 12 is a detailed perspective view of an alternate track clamping means.

FIG. 12 shows a detailed perspective view of the present invention using a track clamping assembly 14 that mounts a base plate 142 to the mounting surface 102 with bolts 144 thereby allowing a user to selectively remove and replace the track member, the upper track clamping member 138 and the lower track clamping member 140 when not needed. The upper track clamp member 138 slidably engages within the track member 12 and secures therein with the lower track clamping member 140 and flush mount bolts 152 that pass through a second set of recesses 150 of and into the threaded recesses on the bottom of the upper track clamping member 138. The lower track clamping member 140 has bolts 144 pass through a first set of recesses 148 thereof and into the threaded recesses 146 of the base plate 142 which is mounted to the mounting surface.

Figure 13:
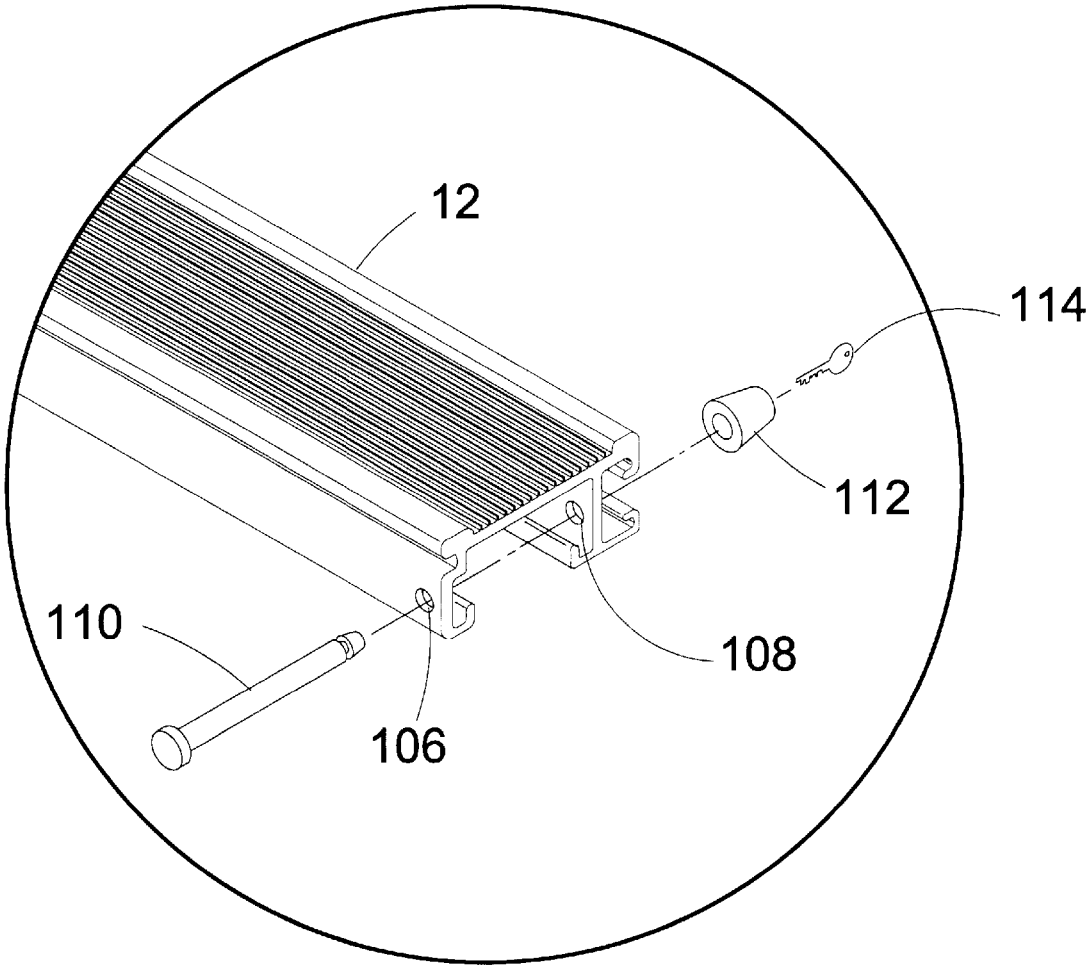
FIG. 13 is a detailed perspective view of the locking means.

FIG. 13 is a detailed perspective view of a lock system of the present invention 10 to prevent the unauthorized removal of the slide mounts 24 and their respective accessories 72 from the track member 12. A locking pin 110 is placed through a locking recess in the first wall of the track member 106 and a locking recess in the second wall of the track member 108 and a lock 112 is placed thereon and locked or unlocked by a key 114.

FIG. 15 is a cross sectional side view of the present invention 10 wherein a rotational force 154 is being exerted upon the track member 12 by an accessory 72 such as a downrigger. The track clamp retaining flanges 52 are locked between the lower track clamping member 34 and the upper track clamping member 32 and within track clamp retaining channels 80 thereof, thereby increasing the tensile integrity of the connection by preventing the spreading and deformation of the track member 12 when subjected to loads.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An accessory mounting track for watercraft comprising:

a) an elongate track member;

b) at least one accessory mounting assembly that is slidably positioned along said track member and selectively and releaseably secured thereto;

c) means for mounting said track member to a mounting surface; and d) said track member comprising:

i) a top plate having a top surface, a bottom surface, a first side, a second side and two ends;

ii) a first wall extending perpendicularly downward from said first side of said top plate and terminating in an L-shaped track clamp retaining flange medially oriented relative to said top plate;

iii) a second wall parallel to said first wall extending from said bottom surface of said top plate and prior to said second side thereof and terminating in an L-shaped track clamp retaining flange on the interior side and a J-channel on the exterior side forming a lower slide clamp containment lip;

iv) an L-shaped flange extending downward from said second side of said top plate forming an upper slide clamp containment lip that works in concert with said second wall and said lower slide clamp containment lip extending therefrom to define a slide clamp recess;

v) a slide mount receiving channel running longitudinally along an upper portion of said first wall subjacent said top plate; and vi) an upper track clamp recess defined by said bottom surface of said top plate, said first wall and its related track clamp retaining flange and said second wall and its related track clamp retaining flange.

2. An accessory mounting track for watercraft as recited in claim 1, wherein said top surface of said top plate of said track member includes a textured, non-skid surface that provides a visible and usable non-skid surface between accessories installed on said slide mounts.

3. An accessory mounting track for watercraft as recited in claim 1, in which track clamp assemblies are secured to said track member in such a fashion as to increase the tensile integrity of the connection especially when increased rotational forces are exerted thereupon.

4. An accessory mounting track for watercraft comprising:

a) an elongate track member;

b) at least one accessory mounting assembly that is slidably positioned along said track member and selectively and releaseably secured thereto;

c) means for mounting said track member to a mounting surface; and d) said means for mounting said track member to a mounting surface is a track clamping assembly comprising:

i) at least two upper track clamping members configured to be slidably inserted into an upper track clamp recess of said track member, said track clamping members having a top, a bottom, at least one bolt recess passing therethrough from said top to said bottom, and two parallel track clamp retaining flange grooves extending longitudinally across the entire length of said bottom;

ii) at least two lower track clamping members, each having a top surface, a bottom surface, two sides wherein the top surface of each side is notched to accommodate a track clamp retaining flange, and at least one bolt recess corresponding with said bolt recesses of said upper track clamping members; and iii) at least one bolt, nut, and washer set-ups for attaching each said lower track clamping member and said upper track clamping member to a relatively flat surface.

5. An accessory mounting track for watercraft as recited in claim 4, wherein installation of the track clamping assembly requires the user to drill holes in the mounting surface to correspond with said bolt recesses in said track clamping members, said bolts are placed through said recesses with the heads of said bolts atop said upper track clamping member and the threaded portions of said bolts reside within said recesses of said upper and lower clamping members and extend below said mounting surface where a washer and a nut are then threaded partially thereon leaving a substantial amount of play between said upper clamping member and said lower clamping member, said track member is positioned end-to-end with said clamping members to align said track clamp retaining flanges of said track member with said track clamp retaining flange grooves of said upper track clamping member and inserted therein until said track member fully covers said upper track clamping member, said nut is tightened thereby pulling said upper track clamping member towards said lower track clamping member and effectively clamping said track clamp retaining flanges of said track member therebetween.

6. An accessory mounting track for watercraft as recited in claim 5, wherein said upper track clamping member further includes a bolt retaining means to prevent said bolt from spinning when said nut is tightened, said bolt is prevented from lifting during tightening due to the presence of said track member immediately overhead.

7. An accessory mounting track for watercraft as recited in claim 5, wherein the track clamping assemblies are spaced close enough to one another to increase the tensile strength of the track member to prevent the distortion thereof when under stress.

8. An accessory mounting track for watercraft as recited in claim 5, wherein the plurality of track clamping assemblies preclude the necessity of providing holes in said track member for installation.

9. An accessory mounting track for watercraft comprising:

a) an elongate track member;

b) at least one accessory mounting assembly that is slidably positioned along said track member and selectively and releaseably secured thereto;

c) means for mounting said track member to a mounting surface;

d) said accessory mounting assembly comprising a slide mount and a clamping means for releasably securing said slide mount in a selected location along said track member.

10. An accessory mounting track for watercraft as recited in claim 9, wherein said slide mount and said slide clamp do not mar, gouge or damage said track member when clamped into position or loosened and repositioned.

11. An accessory mounting track for watercraft comprising:

a) an elongate track member;

b) at least one accessory mounting assembly that is slidably positioned along said track member and selectively and releaseably secured thereto;

c) means for mounting said track member to a mounting surface;

d) said track member further including a locking means on each end thereof for preventing the unauthorized removal of said slide mounts and their respective accessories from said track member.

12. An accessory mounting track for watercraft as recited in claim 11, wherein said locking means comprises:

a) a locking recess in a first wall of said track member;

b) a locking recess in a second wall of said track member horizontally aligned with said locking recess in said first wall;

c) an locking pin having a first end with a flanged head member, a second end with a lock accepting means and an elongate body portion therebetween;

d) a lock; and e) means for locking and unlocking said lock.

13. An accessory mounting track for watercraft as recited in claim 12, wherein said means for locking and unlocking said lock is a key.

14. An accessory mounting track for watercraft as recited in claim 13, wherein said locking pin is inserted through said locking recesses and the lock placed over said lock accepting means and is locked by said key.

15. An accessory mounting track for watercraft comprising:

a) an elongate track member;

b) at least one accessory mounting assembly that is slidably positioned along said track member and selectively and releaseably secured thereto;

c) means for mounting said track member to a mounting surface;

d) said accessory mounting assembly including a quick mounting slide mount comprising:

i) a mounting plate having a top surface, a bottom surface and at least one mounting recess passing therethrough;

ii) a vertical plate extending downward from said top surface having a clamping flange;

iii) at least one recess in said clamping flange; and iv) a clamp bolt that passes through said recess.

16. An accessory mounting track for watercraft as recited in claim 15, wherein said quick mounting slide mount snaps into place anywhere along said track member without having to slide in from an end thereof.

17. An accessory mounting track for watercraft comprising:

a) an elongate track member;

b) at least one accessory mounting assembly that is slidably positioned along said track member and selectively and releaseably secured thereto;

c) means for mounting said track member to a mounting surface;

d) said track member being a direct mount track member which attaches directly to said mounting surface; and e) said direct mount track member comprising:

i) a top plate having a top surface, a bottom surface, a first side, a second side and two ends;

ii) a first wall extending perpendicularly downward from said first side of said top plate and terminating in an L-shaped gull-wing style mounting flange extending outward and having a plurality of screw recesses passing therethrough;

iii) a second wall parallel to said first wall extending from said bottom surface of said top plate and prior to said second side thereof and terminating in an L-shaped track clamp retaining flange on the interior side and a J-channel on the exterior side forming a lower slide clamp containment lip with a mounting flange extending therefrom that has a plurality of screw recesses passing therethrough;

iv) an L-shaped flange extending downward from said second side of said top plate forming an upper slide clamp containment lip that works in concert with said second wall and said J-channel extending therefrom to define a slide clamp recess; and v) a slide mount receiving channel running longitudinally along an upper portion of said first wall subjacent said top plate.

* * * * *